US006172315B1

(12) United States Patent
Miller et al.

(10) Patent No.: US 6,172,315 B1
(45) Date of Patent: Jan. 9, 2001

(54) LINEAR SWITCH HAVING CIRCUMFERENTIAL ACTIVATION

(75) Inventors: Bearge Miller; Norman K. Miller, both of Glen Mills, PA (US)

(73) Assignee: Miller Edge, Inc., Jennersville, PA (US)

( * ) Notice: Under 35 U.S.C. 154(b), the term of this patent shall be extended for 0 days.

(21) Appl. No.: 09/449,425

(22) Filed: Nov. 24, 1999

Related U.S. Application Data

(60) Provisional application No. 60/109,708, filed on Nov. 24, 1998.

(51) Int. Cl.[7] ..... H01H 3/16

(52) U.S. Cl. ..... 200/61.73; 200/61.43; 200/61.41

(58) Field of Search ..... 200/61.43, 61.41–61.44, 200/61.71, 85 R; 49/26–28

(56) References Cited

U.S. PATENT DOCUMENTS

| | | | | |
|---|---|---|---|---|
| 3,732,384 | | 5/1973 | Fischel | 200/86 R |
| 3,812,313 | | 5/1974 | Wolf et al. | 200/86 R |
| 3,896,590 | | 7/1975 | Miller | 49/488 |
| 4,051,336 | | 9/1977 | Miller | 200/61.43 |
| 4,080,519 | | 3/1978 | Michalson | 200/86 R |
| 4,349,710 | | 9/1982 | Miller | 200/61.43 |
| 4,972,054 | | 11/1990 | Miller et al. | 200/61.43 |
| 5,066,835 | | 11/1991 | Miller et al. | 200/61.43 |
| 5,079,417 | | 1/1992 | Strand | 250/221 |
| 5,259,143 | | 11/1993 | Mitchell et al. | 49/27 |
| 5,299,387 | * | 4/1994 | Miller et al. | 49/28 |
| 5,345,671 | | 9/1994 | Miller | 29/622 |
| 5,418,342 | | 5/1995 | Miller et al. | 200/61.43 |
| 5,438,798 | * | 8/1995 | Plamper et al. | 49/28 |
| 5,693,921 | | 12/1997 | Miller et al. | 200/5 A |

* cited by examiner

*Primary Examiner*—Michael L. Gellner
*Assistant Examiner*—Nhung Nguyen
(74) *Attorney, Agent, or Firm*—Mark A. Garzia

(57) ABSTRACT

A linear switch having 360 degree circumferential activation is provided. The switch includes first and second resilient strips separated by an actuator that defines two separate longitudinal channels. A pair of conductive strips, separated by perforated foam, extend the entire length of each channel. An external force applied anywhere along the exterior length or perimeter of the switch will activate it.

15 Claims, 5 Drawing Sheets

LINEAR SWITCH HAVING CIRCUMFERENTIAL ACTIVATION

CROSS-REFERENCE TO RELATED APPLICATION

This application claims the benefit of U.S. Provisional Application Ser. No. 60/109,708, filed Nov. 24, 1998.

FIELD OF THE INVENTION

The present invention relates generally to a contact switch and, more specifically, to a linear contact switch that can be manufactured in continuous lengths and can be activated upon pressure anywhere along its perimeter.

BRIEF DESCRIPTION OF THE PRIOR ART

Linear contact switches (sometimes referred to as edge contact switches) are generally known in the art. The basic elements of a linear contact switch include a pair of elongated conductors centrally located within a cavity of an elongated housing. The housing is comprised of a relatively rigid, flat strip, which forms the bottom of the housing, joined to a flexible, concave-shaped upper section. The bottom strip and the concave upper section define the cavity through which the conductor runs. One elongated conductor is attached to the bottom strip and the other elongate conductor is attached to the upper section of the housing in a spaced apart relationship. A pair of wires soldered to the ends of the conductors are used to connect the linear switch to an external circuit.

Usually, linear contact switches are "normally open" (i.e., in their rest positions the switch does not conduct). The upper section of the housing depresses in response to an external force, thereby moving the upper section along with its associated conductor into contact with the bottom conductor which activates or "closes" the switch.

A drawback of such linear switches is that the external force must be applied at the apex of the concave upper section, and in a substantially perpendicular direction, in order to ensure that the conductors make physical contact, thereby closing the switch. Accordingly, prior art linear switches have "dead" spots along their perimeters or circumferences which would not activate the switch no matter how much external force is applied at that spot. Since a common use for linear switches is on the leading edge of a movable door as part of a safety circuit, the failure of a switch to activate may result in a fatal accident.

Another drawback of prior art linear switches is that they are position sensitive. That is, the linear switch must be precisely located with its bottom strip secured to an object and the concave-shaped upper section projecting outward from the object.

SUMMARY OF THE INVENTION

The present invention is a linear switch that can be activated upon the application of force anywhere along its external perimeter (i.e., along the entire length of the switch as well as any point on the radial circumference of the switch). In other words, the design of the subject invention eliminates "dead" spots.

The subject invention has a non-conductive (i.e., an electrically insulative) housing. Two separate interior channels, separated by an actuator, run the length of the housing. Within each channel, a pair of electrically conductive, flexible strips are secured. One conductive strip from each pair is secured on either side of the actuator with glue, double sided tape or adhesive scrim cloth. The other contact strip from each pair is secured, in diametrically opposite position across their respective channels, to the interior surface of the housing. A perforated foam separator for each pair of conductive strips keeps them in spaced-apart relationship when there is no external force.

A lead wire is soldered onto the first ends of each conductive strip for connecting the switch to a remotely located electrical circuit(s).

Since there are two pairs of conductive strips, one pair in each channel, there are effectively two separate switches. However, in a preferred embodiment, the first conductive strip of the first pair of conductive strips is connected to the first conductive strip of the second pair of conductive strips, and the second conductive strip of the first pair is connected to the second conductive strip of the second pair of conductive strips; the connections are preferably made at the second end of each conductive strip by a wire or jumper. In this preferred embodiment, pressure at any point along the length of the switch—and at any point around the circumference—will activate the actuator thereby closing the subject linear switch (i.e., it has 360 degree sensitivity).

In another aspect, the actuator of the present invention is modified by separating it into two different sections. The subject linear contact switch comprises first and second resilient strips, each having first and second longitudinal edges, an outer surface and an inner surface. First and second complementary strips also having first and second longitudinal edges are joined to the respective first and second longitudinal edges of the first and second resilient strips, respectively, forming two tubular members.

The inner cavity of each tubular member forming first and second channels. The tubular members are then joined together at first and second seams along the entire longitudinal length thereof such that the first and second resilient strips form the outer surface of a housing and the first and second complementary strips form the actuator.

Beads are located along the seams between the resilient strips and the respective complementary strips, and/or between the complementary strips so that the first and second resilient strip remains arched outwards, and the first and second complementary strips are arched slightly outwards in a radially direction to form a third interchannel between the two complementary strips.

As with the previous embodiment, electrically conductive strips are located in the first and second channels. If desired, two oppositely facing conductive strips may also be located in the third channel. The advantage of this embodiment is that the complementary strips, acting as two independent actuators, tend to move in opposite directions upon the application of an external force. This allows two separate surfaces to be connected to the linear switch or, if the conductive strips are jumpered together, to have a backup or fail-safe switch. Further, if the conductive strips are placed in the third channel, a third switch, normally closed, may be needed to respond to changing requirements.

BRIEF DESCRIPTION OF THE DRAWINGS

The foregoing summary, as well as the following detailed description may be better understood when read in conjunction with the accompanying drawings, which are incorporated in and form a part of the specification. The drawings serve to explain the principles of the invention and illustrate embodiments of the present invention that are preferred at the time the application was filed. It should be understood, however, that the invention is not limited to the precise arrangements and instrumentalities shown.

In the drawings.

DETAILED DESCRIPTION OF THE PREFERRED EMBODIMENT

Figure 1:
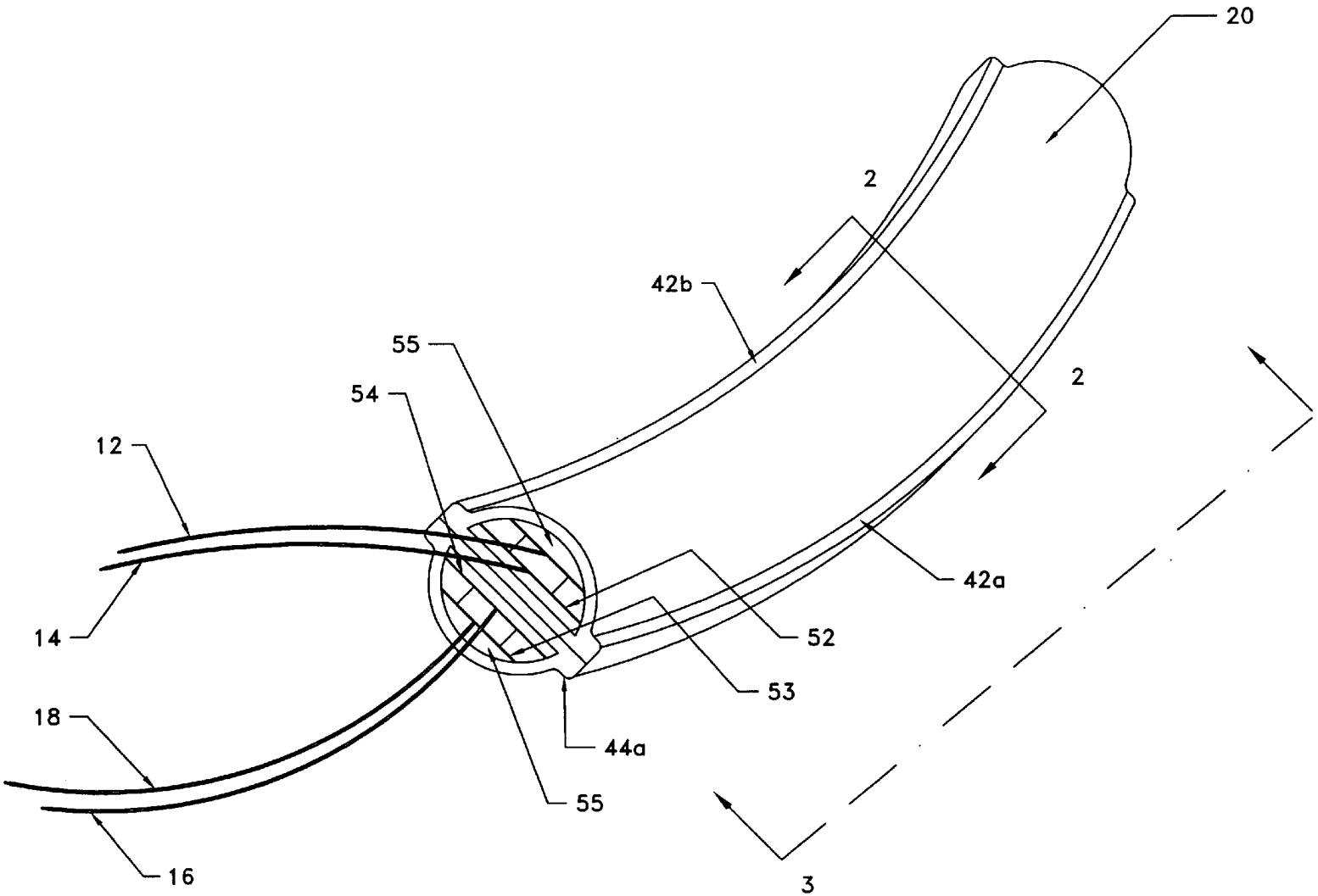
FIG. 1 is a perspective view of a linear contact switch in accordance with the present invention.

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

The terms "right", "left", "lower" and "upper" designate relative directions in the drawings to which reference is made. The terms "inward" and "outward" refer to directions toward and away from, respectively, the geometric center of a specific channel of the linear contact switch.

Preferred embodiments of the present invention will now be described in detail with reference to the accompanying drawings in which a continuous linear contact switch, in accordance with the present invention, is generally indicated at 10.

As indicated above, previous linear switches are directional devices since they only activate when an external force presses against a portion of the switch's perimeter. Therefore, the back of a previous linear switch is mounted to a movable member with the flexible portion (i.e., the outer surface area) of the linear switch projecting away from the movable member.

In its most basic embodiment, the present linear switch 10 is comprised of any elongate switch or sensor attached back-to-back to another elongate sensor (or back-to-back-to-back-etc. if there are three or more sensors). Therefore, at least a portion of the perimeter that is most sensitive to an external force is always facing outwards so that it can be depressed by an external force, thereby maximizing the sensitivity of the switch.

The basic principles and operation of the present linear contact switch are similar to "one-pole" switches, namely, they have an "open" condition where contacts do not touch and an electrical connection is prevented; and they have a "closed" condition where the contacts physically touch and an electrical connection is made. Unless otherwise specified, the subject linear contact switch 10 is in a normally open state (i.e., in its normal resting state, the contacts are not touching).

Referring now to FIG. 1, the preferred embodiment of the subject linear contact switch 10 includes an elongated housing 20 and four leads 12, 14, 16, and 18 for connecting the switch to an external circuit or circuits (not shown). The housing 20 is comprised of a resiliently, flexible material which, in the preferred embodiment, is a polymeric material. Some of the suitable polymeric materials include rubber, neoprene and polyvinyl chloride (PVC). The housing material should be flexible so that it can deflect under an external force and it should be resilient so that, after deflection, it returns to its original or "at rest" position.

Figure 2:
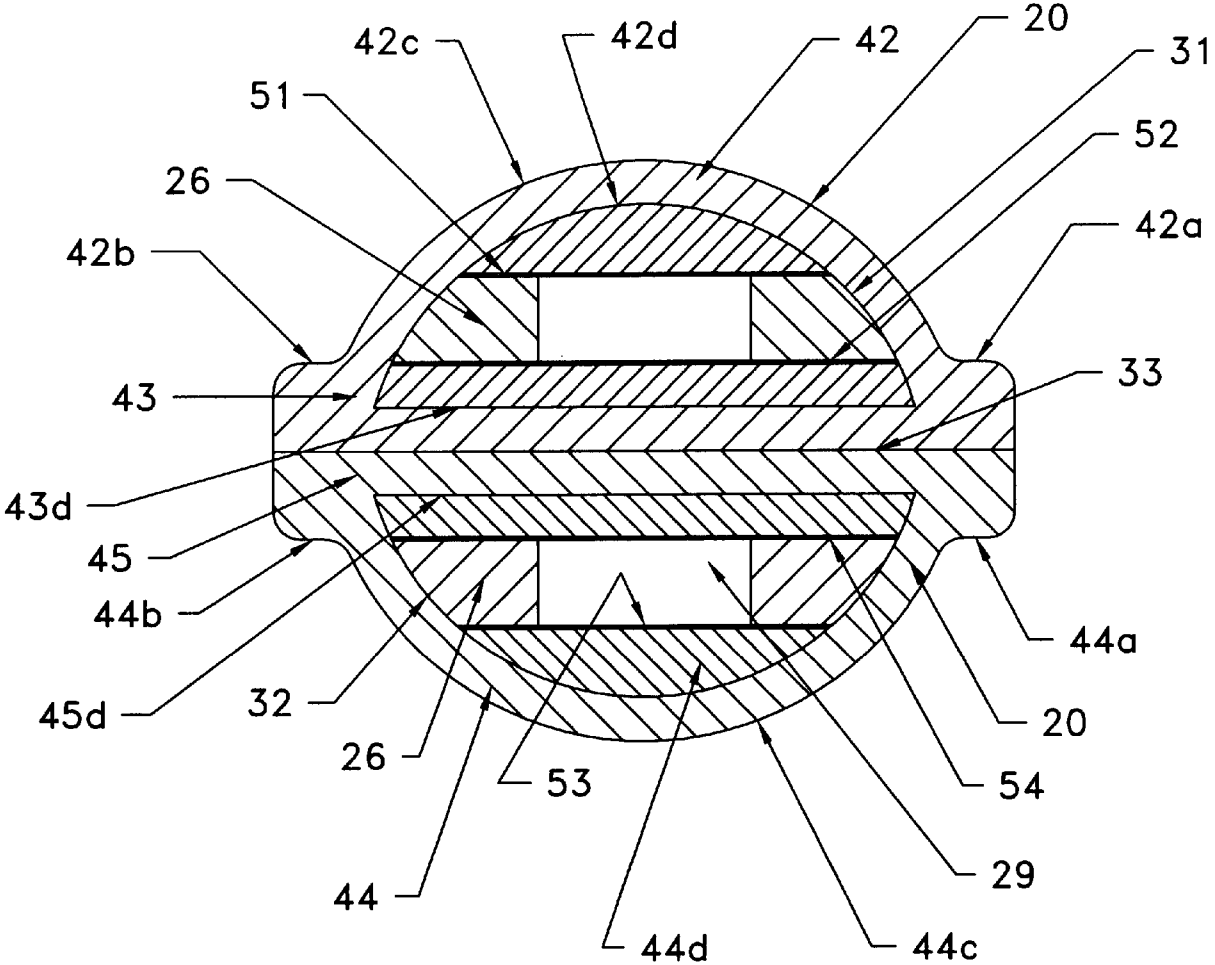
FIG. 2 is a radial cross-sectional view of the linear switch shown in FIG. 1 taken along line 2—2.

As illustrated in FIG. 2, the elongated housing 20 has a generally circular or slightly oval cross-sectional shape when it is at rest (i.e., there is no force bearing on the perimeter of the switch). This shape helps promote the closing of the contacts within the linear switch in response to an external force. The housing 20 has an upper channel 31 and a lower channel 32 separated by a resiliently, flexible actuator 33.

Each channel 31, 32 runs substantially the entire length of the switch 10. When the housing is at rest each channel 31, 32 has a semi-circular or half-moon shape.

In the embodiment illustrated in FIG. 2, the subject invention appears to be similar in construction to the continuous linear contact switch disclosed in U.S. application Ser. No. 08/725,788 filed Oct. 4, 1996, which issued into U.S. Pat. No. 5,693,921 on Dec. 2, 1997. The subject matter of U.S. Pat. No. 5,693,921 being incorporated by reference as if the text was fully set forth herein.

The operation of the subject invention is better understood if the switch 10 is described as joining two separate switches back-to-back. Although the present invention somewhat resembles two linear contact switches disclosed in U.S. Pat. No. 5,693,921 being attached back-to-back, the preferred embodiment of the present linear contact switch 10 includes important features, which will be discussed below, that are not disclosed in U.S. Pat. No. 5,693,921.

Referring again to FIG. 2, the housing 20 of the linear contact switch 10 includes first and second resilient strips 42 and 44, respectively. The first resilient strip 42 has an associated first complementary strip 43 that defines the upper channel 31. The second resilient strip 44 has an associated second complementary strip 45 that defines the lower channel 32. The first resilient strip 42, first complementary strip 43, second resilient strip 44 and second complementary strip 45 all run the entire length of the housing.

The first resilient strip 42 has first and second longitudinal edges 42*a*, 42*b*, an outer surface 42*c* and an inner surface 42*d*. Similarly, second resilient strip 44 has first and second longitudinal edges 44*a*, 44*b*, an outer surface 44*c* and an inner surface 44*d*.

As illustrated in FIG. 1, the respective first and second longitudinal edges 42*a*, 44*a* and 42*b*, 44*b* of the first and second resilient strips 42 and 44 are joined to their respective complementary strips 43, 45 along their entire longitudinal edges, thereby defining first and second channels 31 and 32.

In this embodiment, the two complementary strips 43 and 45 form the actuator 33, and the present invention resembles, in appearance only, two prior art linear contact switches attached back-to-back. However, the separate complementary strips 43, 45 may be replaced by a single resilient strip that forms the actuator 33 and separates the individual channels 31, 32. In this second embodiment, first and second resilient strips 42, 44 are attached to opposite sides of the single resilient strip.

In a preferred embodiment, the means for joining first and second strips 42 and 44 to their respective complementary strips 43, 45 is by a radio frequency (RF) seal which forms a seam by applying high frequency vibration and pressure on the areas of the first and second resilient strips 42, 44 to be joined (i.e., preferably along the first and second longitudinal edges 42*a*, 44*a* and 42*b*, 44*b*, respectively). The resilient strips are attached to their respective complementary strips forming two tubular members having a channel that traverses longitudinally each tubular member. The complementary strips are placed against each other along their entire length and the two tubular members are RF sealed along the first and second longitudinal edges 42*a*, 44*a*, 42*b* and 44*b*, thereby forming a housing for the subject linear switch 10. (See again FIGS. 1 and 2.) Alternatively, the four strips may be sandwiched together in the proper order and RF sealed simultaneously.

Radio frequency sealing is generally known to those skilled in the art and, accordingly, it is not necessary to further describe the sealing method herein. However, it will be understood by those skilled in the art that the first and second seams can be made by means other than radio frequency sealing, such as heat sealing, adhesive sealing, or any suitable joining method depending upon the material being joined.

A first electrically conductive strip 51 is located on the inner surface 42*d* of the first resilient strip 42. A second electrically conductive strip 52 is located along the inner surface 43*d* of the first complementary strip 43. The conductive strip pair 51, 52 are positioned in a substantially diametrically opposed and generally parallel relationship.

A third electrically conductive strip 53 is located on the inner surface 44*d* of the second resilient strip 44. A fourth electrically conductive strip 54 is located along the inner surface 45*d* of the second complementary strip 45. The conductive strip pair 53 and 54 are positioned in a substantially diametrically opposed and generally parallel relationship.

Figure 3:
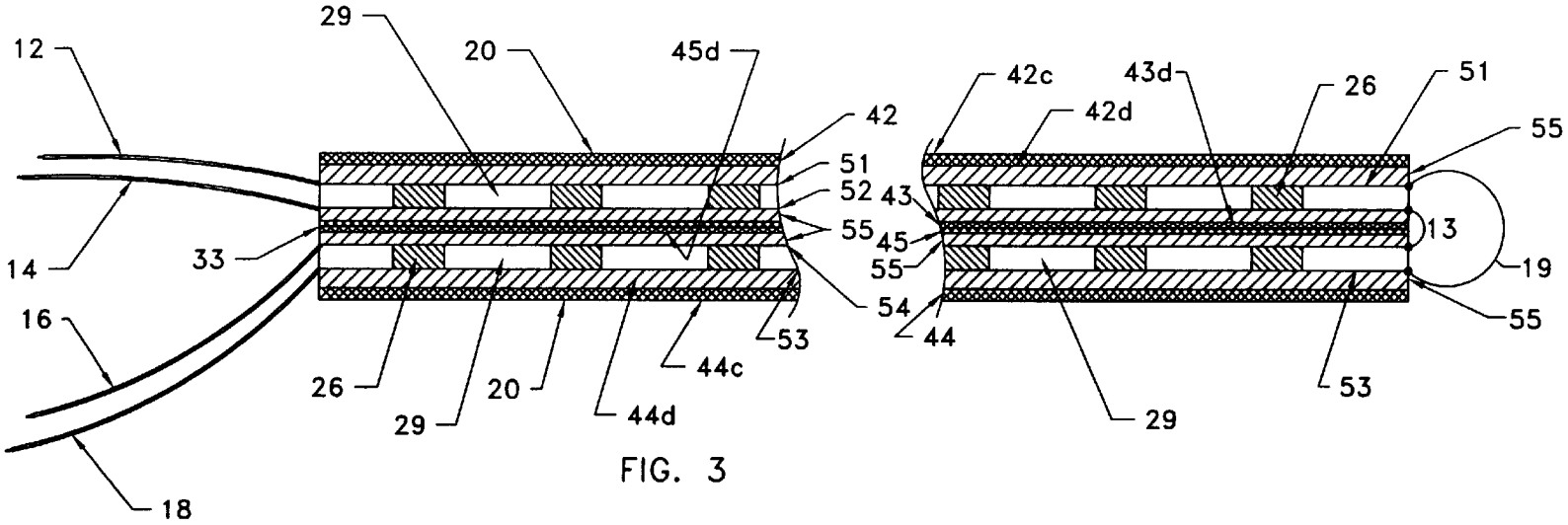
FIG. 3 is a longitudinal cross-sectional view of the linear switch shown in FIG. 1 taken along line 3—3.

As illustrated in FIG. 3, all four conductive strips extend the entire length of the housing 20 and, preferably, in a generally parallel relationship. The conductive strip pair 51, 52 effectively form the terminals of a first switch; the conductive strip pair 53, 54 effectively form the terminals of a second switch. Leads 12, 14 provide the means to connect the first switch to an external circuit. Similarly, leads 16, 18 provide the means to connect the second switch to an external circuit.

The four conductive strips 51, 52, 53 and 54 are flexible and made from a thin sheet of aluminum or from aluminum foil. However, it is within the scope of the present invention to construct the four electrically conductive strips 51, 52, 53 and 54 from copper, brass, silver, conductive plastic, metallic-covered cloth or any other electrically conductive material. Depending on the application and the desired sensitivity, more rigid conductive strips may be utilized in a specific circumstance. Also, the width of each conductive strip may be adjusted independently to control the sensitivity of each switch.

It is understood that any means may be used to secure the conductive strips 51, 52, 53 and 54 to their respective interior surfaces, including glue, epoxy, adhesive double-sided tape or double-sided foam tape. In the preferred embodiment, scrim cloth 55 having adhesive applied to its top and bottom surfaces is used. The scrim cloth 55 helps to support the elongate conductive strips 51, 52, 53 and 54, thereby ensuring that the strips retain their form and integrity.

As shown in FIGS. 2 and 3, two perforated foam separators 26 (one separator in each channel between each pair of conductive strips 51/52 and 53/54) completes the assembly. Each separator 26 extends the entire length of the housing 20 between its respective pair of conductive strips.

Figure 4:
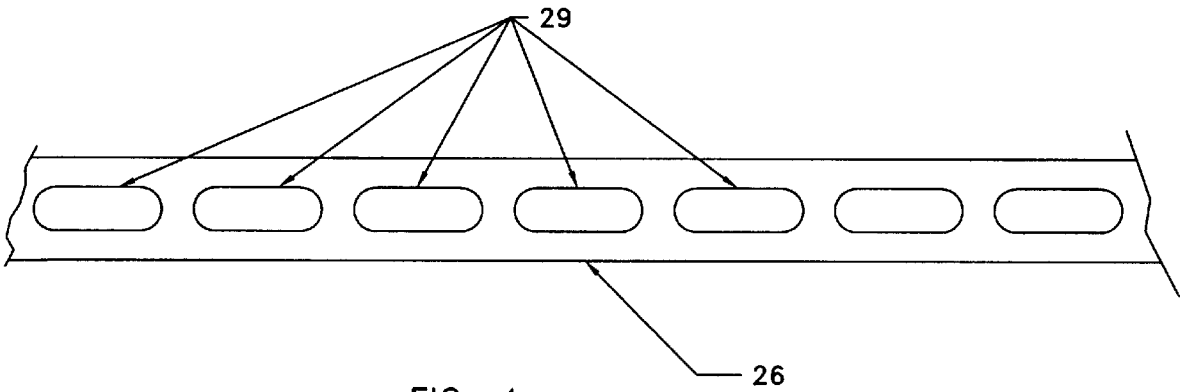
FIG. 4 is a top view of the foam separator used to keep a pair of conductive strips in spaced apart relation and for adjusting the sensitivity of the linear switch in accordance with the present invention.

In the preferred embodiment, the foam separator 26 has a plurality of evenly-spaced oval cut-outs or perforations 29 as illustrated in FIG. 4. The foam separator 26 ensures that the conductive strip pairs remain in a spaced-apart, generally parallel relationship when it is at rest. Further, the thickness and density of the foam, as well as the size, shape and number of the perforations 29 primarily determine the sensitivity of the overall linear switch 10.

It should be noted that the same type of foam separator does not have to be used in the entire length of the switch. There may be circumstances where more (or less) sensitivity is required at a certain section or sections along the switch.

Therefore, a section of thinner foam separator 26 or a section having more (or larger) perforations may be used at certain spots to customize the linear switch. Again, the sensitivity between the first pair of conductive strips 51, 52 may be adjusted independently of the second pair of conductive strips 53, 54.

As shown in FIG. 3, one embodiment includes a first jumper 13 that electrically connects one conductive strip 52 in the upper channel 31 with its counterpart conductive strip 54 in the lower channel 32; and a second jumper 19 that electrically connects the other conductive strip 51 in the upper channel 31 with its counterpart conductive strip 53 in the lower channel 32.

Referring to both FIGS. 1 and 3, a pair of leads 12, 14 are attached to the first pair of conductive strips 51, 52. Similarly, a second pair of leads 16, 18 are attached to the second pair of conductive strips 53, 54. With the jumpers 13, 19 in place, the subject linear switch 10 resembles a single switch having a back-up or fail-safe switch should one switch fail.

It is important to remember that without the jumpers 13, 19, the linear switch 10 actually forms two separate and distinct switches that can operate two independent external circuits. Without jumpers 13, 19, the linear switch 10 is usually manufactured with the actuator 33 made from a single piece of polymeric material and using techniques that ensure that the actuator 33 activates the upper or lower switch depending on the position of the external force on the switch's housing.

The operation of the present switch and, specifically, when an external force is applied to the housing, will now be described with reference to FIGS. 5A and 5B. An important aspect of the present invention is that the actuator 33 is resiliently flexible. When an external force is applied to the linear contact switch 10 having jumpers 13 and 19, one or both pairs of the internal contacts (51/52 or 53/54) make physical contact with each other, thereby completing the circuit and closing the switch.

Figure 5A:
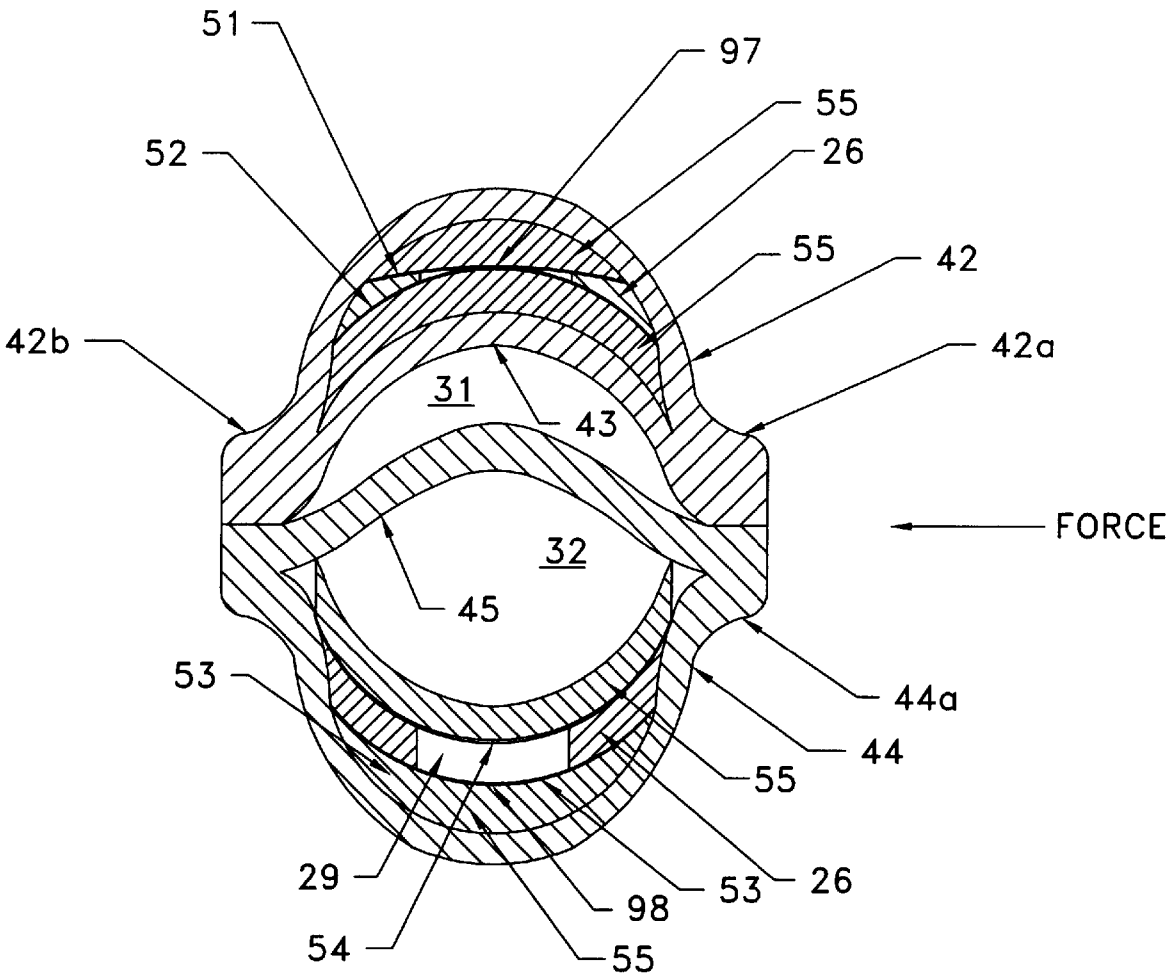
FIG. 5A is a radial cross-sectional view of the present linear switch similar to that shown in FIG. 2 but under external pressure applied to the outer housing.

In FIG. 5A, an external force is applied along the lateral edge 42*a*/44*a*. In this illustration, the force is such that actuator 33 (which is comprised of complementary strips 43 and 45 in this embodiment) is driven upwards thereby deforming channels 31 and 32. The actuator compresses foam separator 26 and forces at least a portion of second electrically conductive strip 52 into physical contact with at least a portion of first electrically conductive strip 51 at contact point(s) 99, thereby closing switch 10. Contact point(s) 97 occur at one or more perforations 29 of the foam separator 26.

It should be noted that if the actuator 33 is formed from a single complementary strip, its operation would be similar to that described above. If two separate complementary strips are used, they are manufactured with the complementary strips laying substantially flat against each other when the switch is at rest.

Referring again to FIGS. 1 and 3, when switch 10 is closed, an external circuit (not shown) detects the closure through leads 12/14 and/or leads 16/18. If the switch 10 is positioned on the leading edge of a garage door, the leads 12/14 and/or leads 16/18 will be connected to a control circuit of a garage door opener. If the garage door encounters an object as it descends, the object will provide the force necessary to close switch 10 (i.e., making contact between leads 12/14 and/or leads 16/18), which, in turn, will send an electrical signal to the control circuit of the garage door opener. The garage door opener can be programmed to either stop immediately all movement of the garage door or reverse the direction of travel of the garage door when it receives the electrical signal from the linear switch 10.

If an external force is applied to either resilient strip 42, 44, the resilient strip will compress one or both foam separators 26 forcing one or both pairs of electrically conductive strips to close. Again, electrical contact will occur at one or more perforations 29 on one or both foam separators 26.

As in previous linear contact switches, the switch may be urged to close by a deflection on the concave outer surface of first or second resilient sections 42, 44. However, even if the external force is not exactly at the apex of resilient sections 42, 44 or is applied against either longitudinal edge, the force will always move the actuator 33 (or complementary strips 43, 45) in one direction or the other (or simultaneously in two opposite directions as shown in FIG. 5B) ensuring that contact is made between at least one pair of conductive strips 51/52 or 53/54, thereby closing the switch. Therefore, the subject linear switch 10 can be activated along its entire length as well as anywhere along its radial perimeter. The subject linear contact switch 10 will close regardless of where pressure is applied on the outer surface, eliminating "dead" spots. Moreover, the operation of the subject linear contact switch 10 is not dependent on an exact location of the apex of a resilient section of the housing.

It will be recognized by those skilled in the art that the first and second resilient strips 42, 44 and the actuator 33 may be at least partially formed from a single piece by an extrusion process which would eliminate the need for separate complementary strips 43, 45. It should be noted that the resiliency of the actuator 33 along with its thickness are also factors that determine the sensitivity (i.e., the amount of external force needed to close switch 10) of the subject linear switch 10.

Figure 5B:
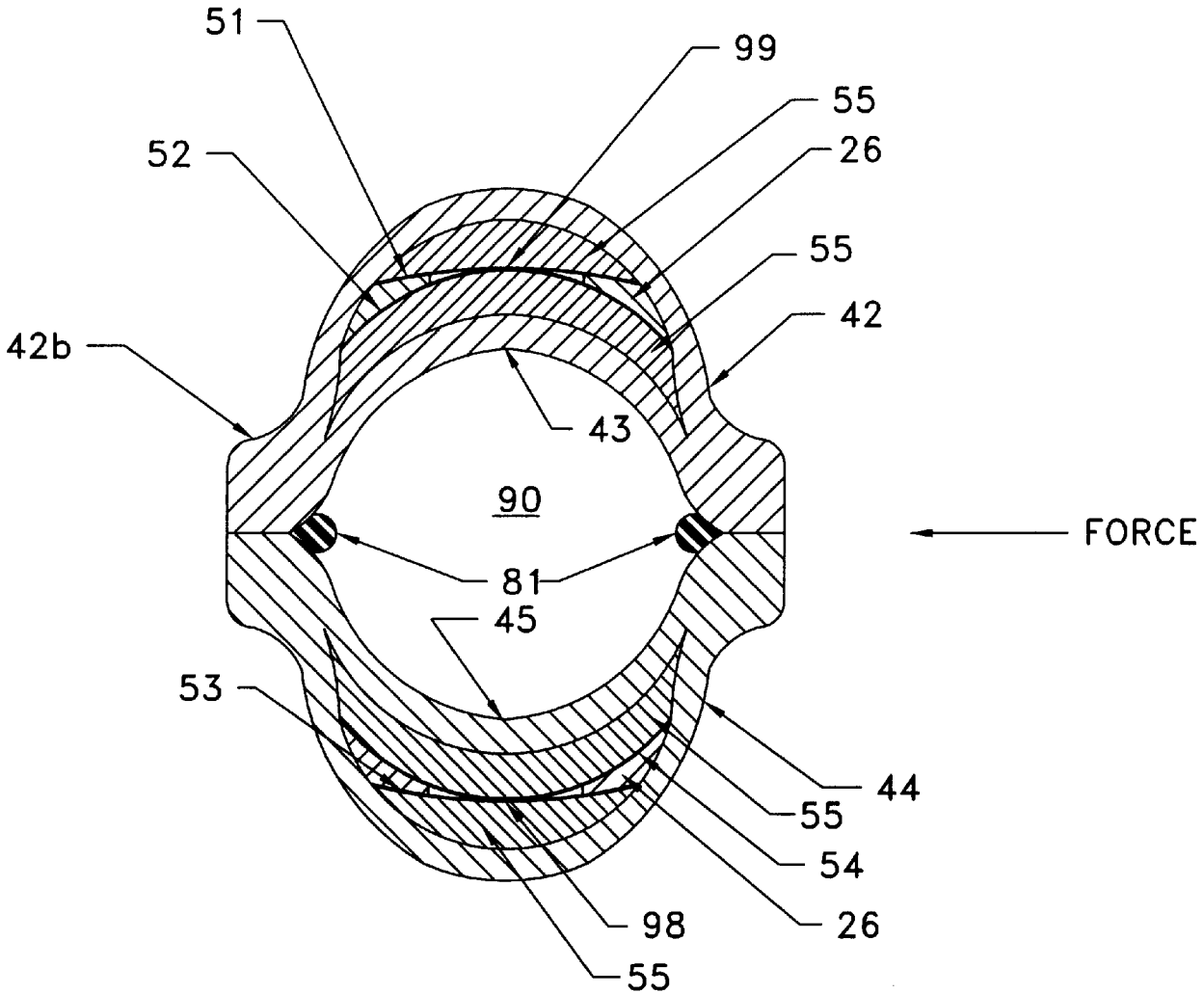
FIG. 5B is a radial cross-sectional view of a second embodiment of a linear contact switch illustrating beaded seams in accordance with the present invention.

As illustrated in FIG. 5B, a second embodiment of the linear switch will now be described in which complementary strip 43 is manufactured with a slight upward concave shape, and complementary strip 45 is manufactured with a slight downward concave shape. In this second embodiment, a third channel 90 will be formed that runs the entire length of the switch.

In this alternate embodiment, an external force will move the complementary strips 43 and 45 radially outward in opposite directions, forcing both pairs of contact strips 51/52 and 53/54 into physical contact at contact points 99 and 98, respectively, as illustrated in FIG. 5B. This embodiment is useful with or without jumpers 13, 19. An advantage of this alternate embodiment is that two unrelated circuits may be simultaneously controlled from a single switch 10.

The diverging positions of the complementary strips 43 and 45 illustrated in FIG. 5B result when the complementary strips 43/45 are designed to have initial concave shapes when the switch is at rest. (The apex of each complementary strip projects radially outward.) Complementary strips 43 and 45 may be manufactured with a slight concave shape by using a more rigid strip of plastic (e.g., polyvinyl chloride) and/or forming beads 81 at one or both of the seams between first complementary strip 43 and second complementary strip 45 intermittently at spaced intervals or along the entire longitudinal edges. One manufacturing technique to achieve this is to add extra polymeric material during the RF sealing process so that a bead 81 forms along each longitudinal edge between the complementary strips 43, 45 as shown in FIG. 5B.

Although not shown, a third pair of conductive strips may be placed in the newly formed third channel 90 thereby forming a third switch. This third switch is "normally" closed and any external pressure would separate the two conductors opening the switch.

Linear switches may be held in place by a C-channel or other suitable means. In previous linear switches, the switch had to be installed with a specific orientation in order to function properly (i.e., with the concave or resilient section facing directly outward). It would take extra time to ensure that previous linear switches were properly installed and to maintain them in their proper position. In contrast, the subject invention may be installed without regard to orientation since it can be activated along its entire length and its entire circumference.

Another important feature of the subject invention is the ability to refine the sensitivity of the linear switch 10 by changing the physical properties of the foam separator 26 (thickness, density, shape and number of perforations) or by changing the resiliency of the actuator 33.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

We claim:

1. A linear contact switch having continuous circumferential activation, comprising:

an elongate, tubular housing comprised of first and second resilient strips;

a resilient actuator that substantially bisects the tubular housing and defines first and second channels; and a pair of electrically conductive strips secured within each channel, the strips of each pair of conductive strips being in diametrically opposed position and generally parallel relationship, one strip of the first pair of conductive strips attached to the side of the actuator facing inwards towards the first channel, the other strip of the first pair attached to the inner side of said first section, and wherein one strip of the second pair of conductive strips is attached to the side of the actuator facing inwards towards the second channel, the other strip of the first pair attached to the inner side of said second section.

2. The linear switch of claim 1 further comprising:

a perforated foam separator sandwiched between each pair of conductive strips.

3. The linear switch of claim 2 further comprising means connected to each of the electrically conductive strips for making a connection to an external circuit.

4. The linear switch of claim 3 wherein said connection means are individual wires.

5. The linear switch of claim 2 wherein said perforations of the foam separator comprises a plurality of evenly spaced oval-shaped cut-outs.

6. The linear switch of claim 2 wherein said sensitivity of the switch is affected by the density and thickness of the foam separator.

7. The linear switch of claim 1 further comprising a scrim cloth backing for each conductive strip to provide support and ensure the integrity of the conductive strips.

8. The linear switch of claim 1 wherein said sensitivity of the switch is affected by the flexibility and resiliency of the actuator.

9. The linear switch of claim 1 further comprising a first jumper that electrically connects a first conductive strip of said first pair of conductive strips to a first conductive strip of said second pair of conducting strips, and a second jumper that electrically connects a second conductive strip of said first pair of conductive strips to a second conductive strip of said second pair of conducting strips.

10. The linear contact switch of claim 1 wherein an external force anywhere against said housing moves the actuator, which in turn forces either of said pair of electrically conductive strips to make contact, thereby closing the linear contact switch.

11. A linear contact switch having circumferential activation, comprising:

a) a housing, including:

an elongate first resilient strip having an outer surface and an inner surface;

an actuator having a first side and a second side; and an elongate second resilient strip having an outer surface and an inner surface, said first resilient strip, said actuator and said second resilient strip each having first and second longitudinal edges, the first and second longitudinal edges of said actuator being joined to the first and second longitudinal edges, respectively, of said first resilient strip and said second resilient strip at first and second seams along substantially their entire longitudinal length, so that the inner surface of said first resilient strip and the first side of said actuator define a first channel through the entire longitudinal length of the housing, and the inner surface of said second resilient strip and the second side of said actuator define a second channel through the entire longitudinal length of the housing;

b) a first flexible, electrically conductive strip located on the inner surface of the first resilient strip;

c) a second flexible, electrically conductive strip located on the first side of the actuator facing said first electrically conductive strip;

d) a third flexible, electrically conductive strip located on the inner surface of the second resilient strip;

e) a fourth flexible, electrically conductive strip located on the second side of the actuator facing said third electrically conductive strip;

f) a first perforated foam separator positioned in said first channel between said first and second flexible, electrically conductive strips for preventing incidental contact between said first and second electrically conductive strips; and g) a second perforated foam separator positioned in said second channel between said third and fourth flexible, electrically conductive strips for preventing incidental contact between said third and fourth electrically conductive strips.

12. The continuous linear contact switch according to claim 11, wherein said actuator comprises first and second complementary strips, said first complementary strip defining the first channel with said first resilient strip, and said second complementary strip defining the second channel with said second resilient strip, the complementary strips being capable of movement independent of each other upon the application of a force on the outer surface of the housing.

13. The continuous linear contact switch according to claim 12 further comprising beads located along at least one of the seams between the first and second complementary strips so that the complementary strips remain generally arched away from each other when the switch is at rest, to form an inner cavity between the complementary strips.

14. The continuous linear contact switch of claim 13 further comprising a first jumper electrically connecting the first conductive strip to the third conductive strip, and a second jumper connecting the second conductive strip to the fourth conductive strip.

15. The continuous linear contact switch of claim 13 further comprising lead wires connected to each conductive strip for connecting the contact switch to external circuits.

* * * * *